US009488002B2

(12) United States Patent
Parker et al.

(10) Patent No.: US 9,488,002 B2
(45) Date of Patent: Nov. 8, 2016

(54) STEPLADDER WITH LATCH STUD AND METHOD

(71) Applicants: Thomas W. Parker, Jamestown, PA (US); Brian A. Wong Shui, Atlanta, GA (US); Devin Lee Moore, Decatur, GA (US); Christian M. Otis, New Haven, CT (US); Erick E. Rios, New Haven, CT (US)

(72) Inventors: Thomas W. Parker, Jamestown, PA (US); Brian A. Wong Shui, Atlanta, GA (US); Devin Lee Moore, Decatur, GA (US); Christian M. Otis, New Haven, CT (US); Erick E. Rios, New Haven, CT (US)

(73) Assignee: Werner Co., Greenville, PA (US)

( * ) Notice: Subject to any disclaimer, the term of this patent is extended or adjusted under 35 U.S.C. 154(b) by 48 days.

(21) Appl. No.: 14/668,526

(22) Filed: Mar. 25, 2015

(65) Prior Publication Data

US 2015/0211297 A1 Jul. 30, 2015

Related U.S. Application Data

(62) Division of application No. 13/738,598, filed on Jan. 10, 2013, now Pat. No. 8,997,931.

(51) Int. Cl.

| | |
|---|---|
| ***E06C 1/393*** | (2006.01) |
| ***E06C 1/383*** | (2006.01) |
| ***E06C 1/387*** | (2006.01) |
| *A47C 12/00* | (2006.01) |

(52) U.S. Cl.

CPC ..... *E06C 1/383* (2013.01); *E06C 1/387* (2013.01); *E06C 1/393* (2013.01); *A47C 12/00* (2013.01)

(58) Field of Classification Search

CPC ..... E06C 1/383; E06C 1/393; E06C 1/39

USPC ..... 182/115, 116, 124, 125, 126, 156, 163, 182/165, 171, 175, 179.1, 180.1, 180.2, 22, 182/23, 33

See application file for complete search history.

(56) References Cited

U.S. PATENT DOCUMENTS

| | | | | | |
|---|---|---|---|---|---|
| 1,946,747 | A * | 2/1934 | Laborda | E06C 1/16 | 182/177 |
| 1,992,391 | A * | 2/1935 | Pease | E06C 1/393 | 182/125 |
| 2,299,584 | A * | 10/1942 | Low | E06C 1/32 | 16/333 |
| 2,507,396 | A * | 5/1950 | Boggs | E06C 7/182 | 182/106 |
| 2,521,114 | A * | 9/1950 | Campbell | E06C 1/18 | 182/116 |
| 2,596,521 | A * | 5/1952 | Bell | E06C 1/387 | 182/156 |
| 2,962,111 | A * | 11/1960 | McKinnie | E06C 1/18 | 182/116 |
| 3,016,103 | A * | 1/1962 | Studer | E06C 7/44 | 182/126 |

(Continued)

*Primary Examiner* — Daniel Cahn

(74) *Attorney, Agent, or Firm* — Ansel M. Schwartz

(57) ABSTRACT

A stepladder includes a front section having a first front leg and a second front leg. The stepladder includes a step attached to the first front leg and the second front leg. The stepladder includes a latch engaged with the step. The stepladder includes a rear section having a first rear leg and a second rear leg and a cross bar attached to the first rear leg and the second rear leg. The rear section is pivotably attached to the front section. The rear section has a first stud which extends from the first rear leg toward the second rear leg and separate and apart and not in contact with the second rear leg and not in contact with the cross bar. The latch is engaged with and latched to the first stud to define an engaged position where the first front leg and the first rear leg are in an open position and form an inverted v shape and are prevented from folding together, and the latch when pulled up from the engaged position, disengages from the first stud and allows the front section and rear section to fold together into a closed position where the first rear leg and the first front leg are in parallel. A method of positioning a step ladder.

2 Claims, 10 Drawing Sheets

(56) References Cited

U.S. PATENT DOCUMENTS 4,100,998 A * 7/1978 Marquez ..... E06C 7/16 182/116
4,130,316 A * 12/1978 Rossi ..... A47C 12/02 182/156
4,155,422 A * 5/1979 Larson ..... E06C 1/32 182/124
4,320,817 A * 3/1982 Knoke ..... A47C 12/02 182/126
4,485,892 A * 12/1984 Maloney ..... E06C 1/393 182/161
5,722,507 A * 3/1998 Kain ..... E06C 1/393 182/104
5,762,163 A * 6/1998 Kain ..... E06C 1/393 182/161
5,992,567 A * 11/1999 Chiu ..... E06C 1/387 182/161
6,012,548 A * 1/2000 Kim ..... E06C 1/387 182/156
6,026,933 A * 2/2000 King ..... E06C 1/387 182/161
6,427,805 B1 * 8/2002 Gibson ..... E06C 1/387 182/165
6,443,261 B1 * 9/2002 Gibson ..... E06C 1/16 182/104
6,550,579 B2 * 4/2003 Gibson ..... E06C 1/387 182/161
7,108,103 B2 * 9/2006 Meeker ..... E06C 7/087 182/165
8,002,084 B2 * 8/2011 Huang ..... E06C 1/18 182/159
8,127,890 B2 * 3/2012 Meyers ..... A47C 12/00 182/156
8,684,139 B2 * 4/2014 Leng ..... A47C 12/00 182/129
2003/0057022 A1 * 3/2003 Leng ..... E06C 1/393 182/165
2005/0029050 A1 * 2/2005 Baumgartner ..... E06C 1/393 182/165
2005/0284701 A1 * 12/2005 Gibson ..... A47C 12/00 182/165
2007/0181369 A1 * 8/2007 Gibson ..... E06C 1/393 182/165
2008/0142301 A1 * 6/2008 Meyers ..... E06C 1/387 182/180.1
2009/0020360 A1 * 1/2009 May ..... B60R 3/02 182/1

* cited by examiner

STEPLADDER WITH LATCH STUD AND METHOD

CROSS-REFERENCE TO RELATED APPLICATIONS

This is a divisional of U.S. patent application Ser. No. 13/738,598 filed Jan. 10, 2013, now U.S. Pat. No. 8,997,931, incorporated by reference herein.

FIELD OF THE INVENTION

The present invention is related to a stepladder that may be securely placed in an open position. (As used herein, references to the "present invention" or "invention" relate to exemplary embodiments and not necessarily to every embodiment encompassed by the appended claims.) More specifically, the present invention is related to a stepladder that may be securely placed in an open position that has a first stud separate and apart from a cross bar that a latch engages to lock the stepladder in the open position.

BACKGROUND OF THE INVENTION

This section is intended to introduce the reader to various aspects of the art that may be related to various aspects of the present invention. The following discussion is intended to provide information to facilitate a better understanding of the present invention. Accordingly, it should be understood that statements in the following discussion are to be read in this light, and not as admissions of prior art.

It is desirable that a folding stepladder lock securely in the open in-use position so as to prevent accidental folding and possible injury to the user. In addition, a desirable latch design is one that is secure when latched, easily unlatched when the user intends to fold the stepladder, and provides the user an indication that the latch is properly engaged upon opening the stepladder for use. The stepladder latch described here provides these desirable characteristics.

BRIEF SUMMARY OF THE INVENTION

The present invention pertains to a stepladder. The stepladder comprises a front section having a first front leg and a second front leg. The stepladder comprises a step attached to the first front leg and the second front leg. The stepladder comprises a latch engaged with the step. The stepladder comprises a rear section having a first rear leg and a second rear leg and a cross bar attached to the first rear leg and the second rear leg. The rear section is pivotably attached to the front section. The rear section has a first stud which extends from the first rear leg toward the second rear leg and separate and apart and not in contact with the second rear leg and not in contact with the cross bar. The latch is engaged with and latched to the first stud to define an engaged position where the first front leg and the first rear leg are in an open position and form an inverted v shape and are prevented from folding together, and the latch when pulled up from the engaged position, disengages from the first stud and allows the front section and rear section to fold together into a closed position where the first rear leg and the first front leg are in parallel.

The present invention pertains to a method of positioning a stepladder. The method comprises the steps of pivoting a front section having a first front leg and a second front leg relative to a rear section having a first rear leg and a second rear leg and a cross bar attached to the first rear leg and the second rear leg to an open position. The rear section has a first stud which extends from the first rear leg toward the second rear leg and is separate and apart and not in contact with the second rear leg and not in contact with the cross bar. There is the step of engaging a latch to the first stud to define an engaged position where the first front leg and the first rear leg are in an open position and form an inverted v shape and are prevented from folding together. The latch is engaged with a step and the step is attached to the first front leg and the second front leg. There is the step of pulling up on the latch from the engaged position to disengage the latch from the first stud. There is the step of folding the front section and rear section together into a closed position where the first rear leg and the first front leg are in parallel.

BRIEF DESCRIPTION OF THE SEVERAL VIEWS OF THE DRAWING

In the accompanying drawings, the preferred embodiment of the invention and preferred methods of practicing the invention are illustrated in which.

DETAILED DESCRIPTION OF THE INVENTION

Figure 1:
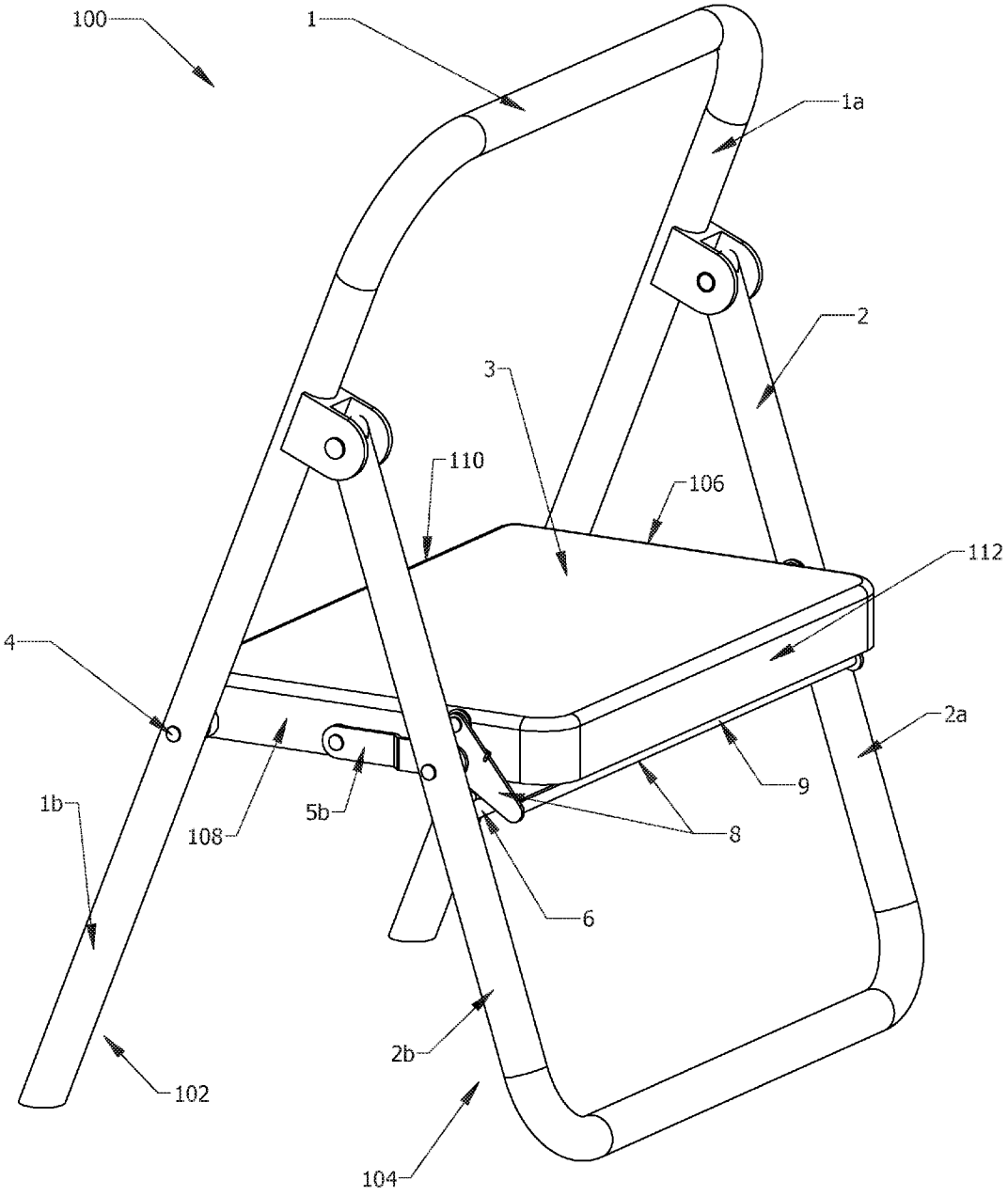
FIG. 1 is an overhead perspective view of the step ladder of the present invention in an open position.
Figure 2:
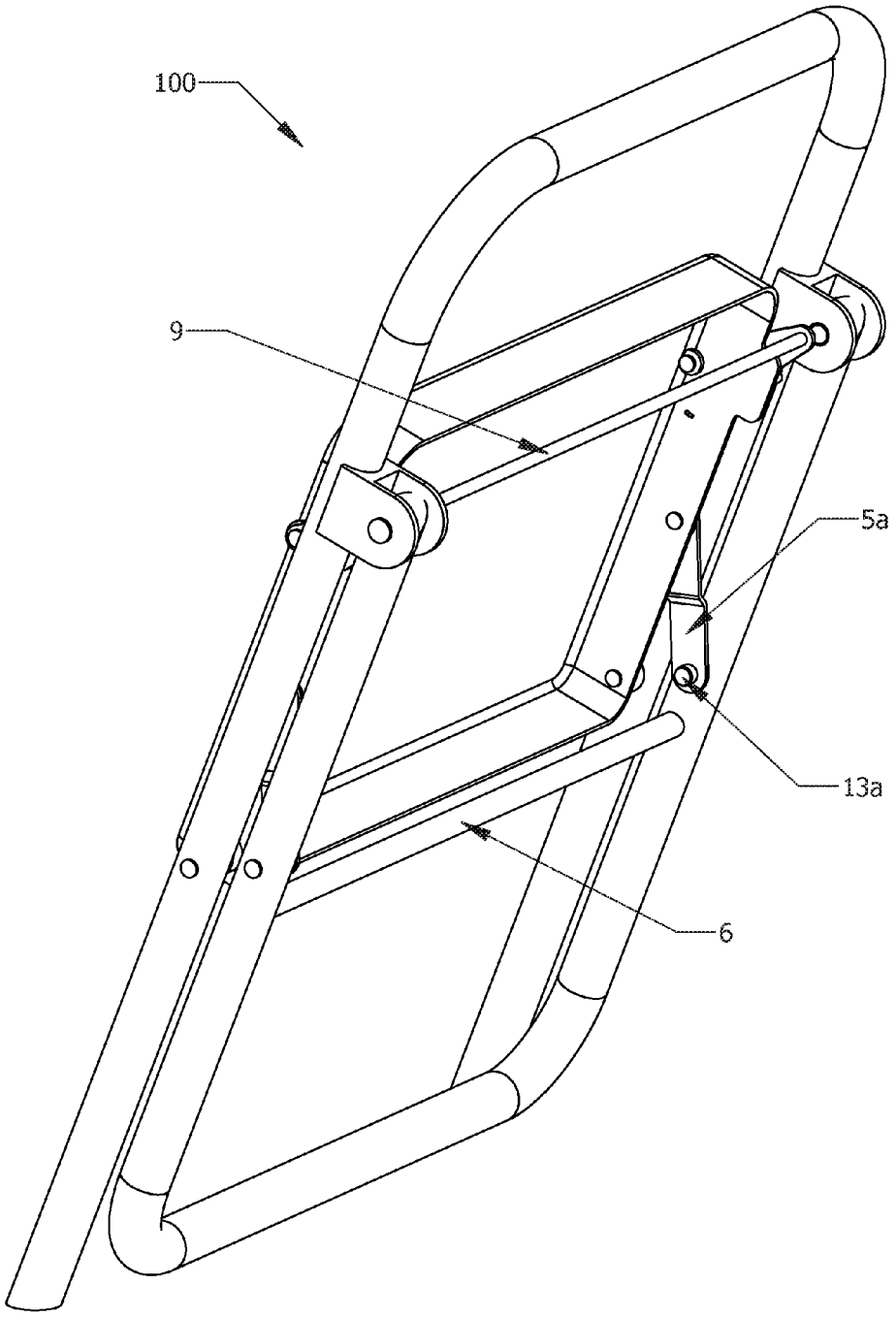
FIG. 2 is an overhead perspective view of the step ladder in a closed position.

Referring now to the drawings wherein like reference numerals refer to similar or identical parts throughout the several views, and more specifically to FIGS. 1 and 2 thereof, there is shown a stepladder 100. The stepladder 100 comprises a front section 102 having a first front leg 1*a* and a second front leg 1*b*. The stepladder 100 comprises a step 3 attached to the first front leg 1*a* and the second front leg 1*b*. The stepladder 100 comprises a latch 8 engaged with the step 3. The stepladder 100 comprises a rear section 104 having a first rear leg 2*a* and a second rear leg 2*b* and a cross bar 6 attached to the first rear leg 2*a* and the second rear leg 2*b*. The rear section 104 is pivotably attached to the front section 102. The rear section 104 has a first stud 13*a* which extends from the first rear leg 2*a* toward the second rear leg 2*b* and separate and apart and not in contact with the second rear leg 2*b* and not in contact with the cross bar 6. The latch 8 is engaged with and latched to the first stud 13*a* to define an engaged position where the first front leg 1*a* and the first rear leg 2*a* are in an open position and form an inverted v shape and are prevented from folding together, and the latch 8 when pulled up from the engaged position, disengages from the first stud 13*a* and allows the front section 102 and rear section 104 to fold together into a closed position where the first rear leg 2*a* and the first front leg 1*a* are in parallel.

Figure 3:
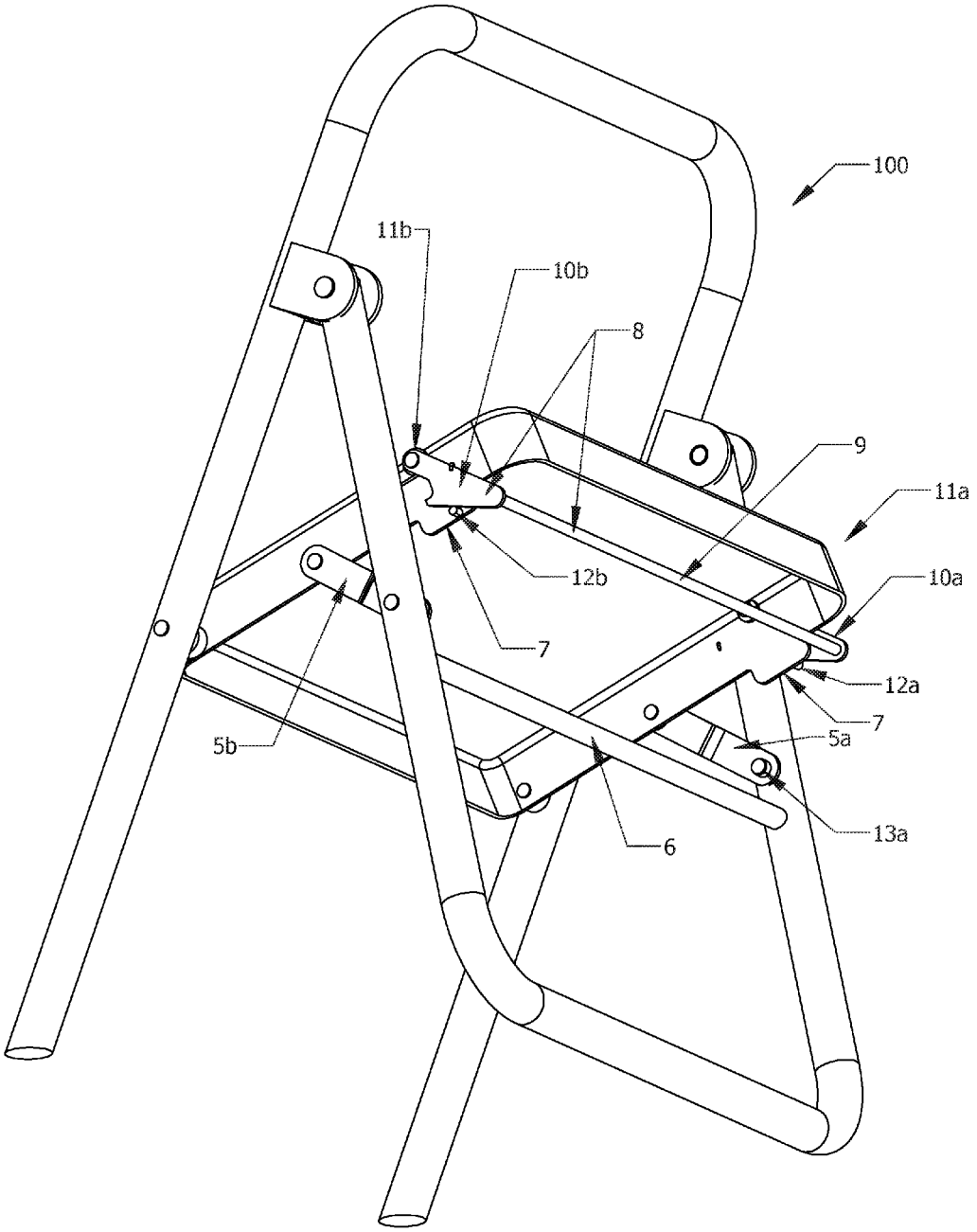
FIG. 3 is an underside perspective view of the stepladder.
Figure 5:
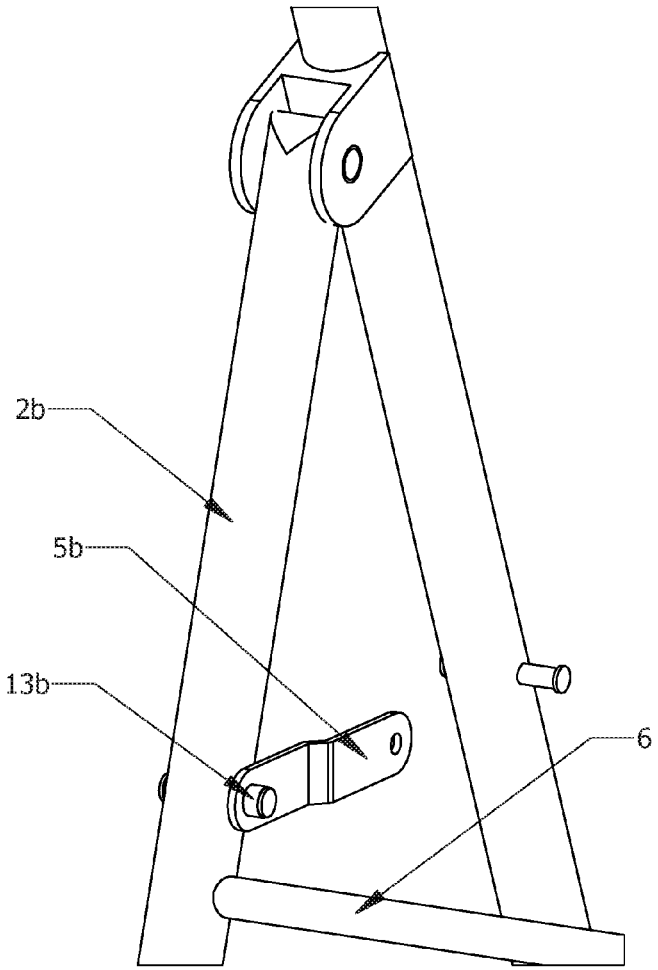
FIG. 5 shows a first front rail and a first rear rail.

The latch 8 may have a first latch end 10*a* that engages with the first stud 13*a* and a second latch end 10*b* that engages with a second stud 13*b* when the latch 8 is in the engaged position, as shown in FIGS. 3 and 5. The rear section 104 may have a second stud 13*b* which extends from the second rear leg 2*b* toward the first rear leg 2*a* and is separate and apart and not in contact with the first rear leg 2*a* and the first stud 13*a* and not in contact with the cross bar 6. The latch 8 may include a latch bar 9 connected to the first latch end 10*a* and the second latch end 10*b* which causes movement of the first and second latch ends 10*a*, 10*b* to occur in unison. The latch bar 9 may be disposed below the step 3 when the latch 8 is in the engaged position. The latch 8 may include a restoring mechanism which moves the first and second latch end 10*a*, 10*b* which causes movement of the first and second latch ends 10*a*, 10*b* to occur in unison. The latch bar 9 may be disposed below the step 3 when the latch 8 is in the engaged position. The latch 8 may include a restoring mechanism which moves the first and second latch ends 10*a*, 10*b* into engagement with the first and second studs 13*a*, 13*b*, respectively, from a disengaged position of the latch 8 when the first and second latch ends 10*a*, 10*b* do not engage the first and second studs 13*a*, 13*b*, respectively. The restoring mechanism may include a first spring 11*a* which engages with the first latch end 10*a* and a second spring 11*b* which engages with the second latch end 10*b*.

Figure 8:
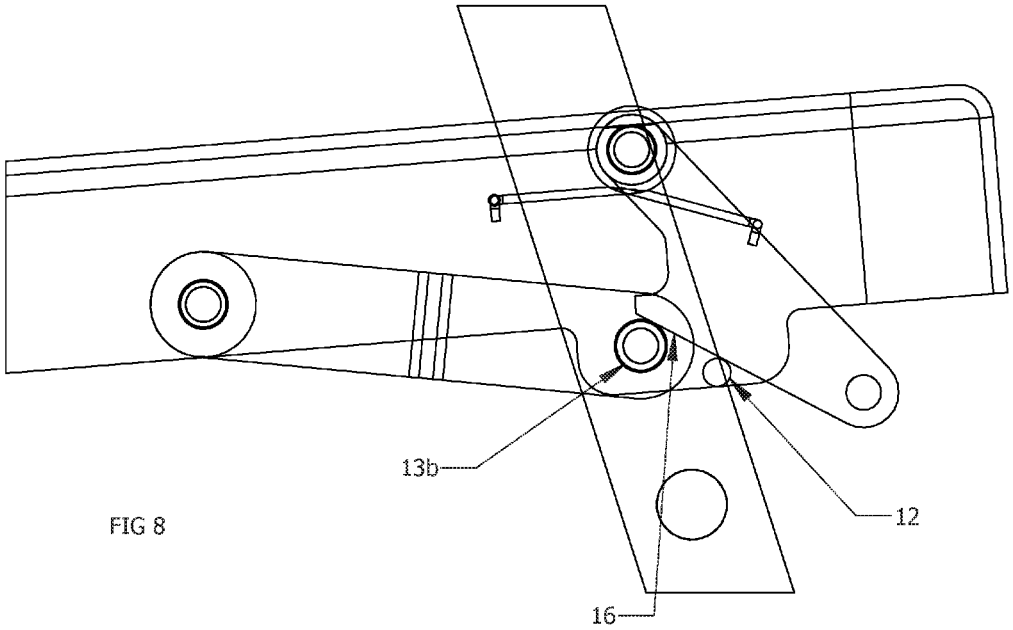
FIG. 8 is a side view of the step and latch end.

The step 3 may include a first side 106, a second side 108, a front 110 and a rear 112, and including a first step link 5*a* attached to the first rear leg 2*a* and the first side 106 of the step 3; and a second step link 5*b* attached to the second rear leg 2*b* and the second side 108 of the step 3. The crossbar may support the rear 112 of the step 3 when the latch 8 is in an engaged position. Each latch end may have a cam portion 16, as shown in FIG. 8. As the cam portion 16 contacts the respective stud when the rear 112 of the step 3 is moved downward, the cam portion 16 moves so that a hook portion 14 of the latch end, shown in FIG. 6, bypasses the respective stud until the hook portion 14 clears the respective stud, at which point the respective spring moves the hook portion 14 to engage the respective stud and place the latch 8 into the engaged position.

The step 3 may include a first stop 12*a* disposed on the first side 106 of the step 3 and a second stop 12*b* disposed on the second side 108 of the step 3, as shown in FIG. 3, which prevent the latch 8 from rotating beyond a desired position. Each hook portion 14 of each latch 8 may be disposed beneath the respective stud and held there by torque supplied by the respective spring. The first stud 13*a* may not support the step 3. The stepladder 100 may include a latch pivot 20 which extends through a latch end and a boss 120 on the step 3 and about which the coil section of the spring is positioned.

The present invention pertains to a method of positioning a stepladder 100. The method comprises the steps of pivoting a front section 102 having a first front leg 1*a* and a second front leg 1*b* relative to a rear section 104 having a first rear leg 2*a* and a second rear leg 2*b* and a cross bar 6 attached to the first rear leg 2*a* and the second rear leg 2*b* to an open position. The rear section 104 has a first stud 13*a* which extends from the first rear leg 2*a* toward the second rear leg 2*b* and is separate and apart and not in contact with the second rear leg 2*b* and not in contact with the cross bar 6. There is the step of engaging a latch 8 to the first stud 13*a* to define an engaged position where the first front leg 1*a* and the first rear leg 2*a* are in an open position and form an inverted v shape and are prevented from folding together. The latch 8 is engaged with a step 3 and the step 3 is attached to the first front leg 1*a* and the second front leg 1*b*. There is the step of pulling up on the latch 8 from the engaged position to disengage the latch 8 from the first stud 13*a*. There is the step of folding the front section 102 and rear section 104 together into a closed position where the first rear leg 2*a* and the first front leg 1*a* are in parallel.

There may be the steps of contacting the first stud 13*a* with a cam portion 16 of a first latch end 10*a* of the latch 8; moving the cam portion 16 so that a hook portion 14 of the first latch end 10*a* bypasses the first stud 13*a*; and moving the hook portion 14 clockwise to engage the first stud 13*a* and place the latch 8 into the engaged position after the hook portion 14 clears the first stud 13*a*.

In the operation of the invention, the following describes the design and operation of the disclosed latch 8 as applied to the simplified single-step folding stepladder seen in FIGS. 1, 2, and 3. It should be understood that this latch 8 design could also be applied to folding stepladders having multiple steps.

FIG. 1 shows the stepladder in the open position. Front legs 1 are hinged to the rear legs 2. A step 3 is attached to the front legs 1 by rivets 4 so that the step 3 can pivot to a closed position seen in FIG. 2. Step links 5 are pivotally connected to the step 3 and to the rear legs 2. The step links cause the rear legs to move to a position parallel to the front legs when the stepladder is folded.

A cross bar 6 is rigidly attached to the rear legs 2. The cross bar 6 provides added stiffness to the rear legs and supports the rear 112 of the step 3 when in the open position by way of projections 7 on the underside of the step 3 which contact the cross bar 6. This can be seen in FIG. 6.

Figure 4:
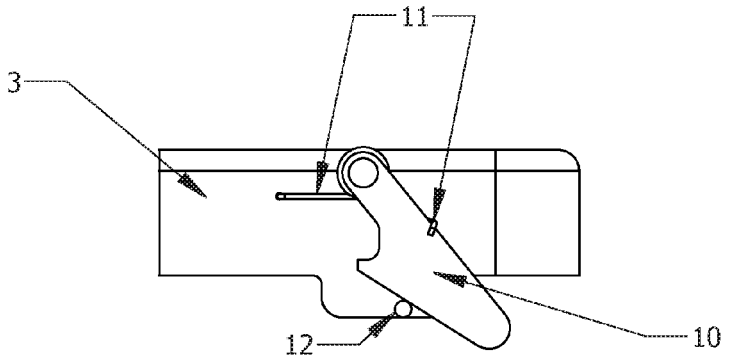
FIG. 4 is a side view of the step and latch end.

A symmetric latch 8 is pivotally attached to the sides of the step 3. The latch 8 consists of a latch bar 9 and two latch ends 10. This is seen in FIG. 3. Springs 11 are symmetrically mounted at both ends of the latch 8 in such a way as to apply a torque to the latch 8. The torque is in a CW direction when seen in FIG. 4, which is a view with the rear legs, etc, removed for clarity. Stops 12 on both sides of the step 3 (FIGS. 3 & 4) prevent the latch 8 from rotating CW beyond the position shown in FIG. 4.

Figure 11:
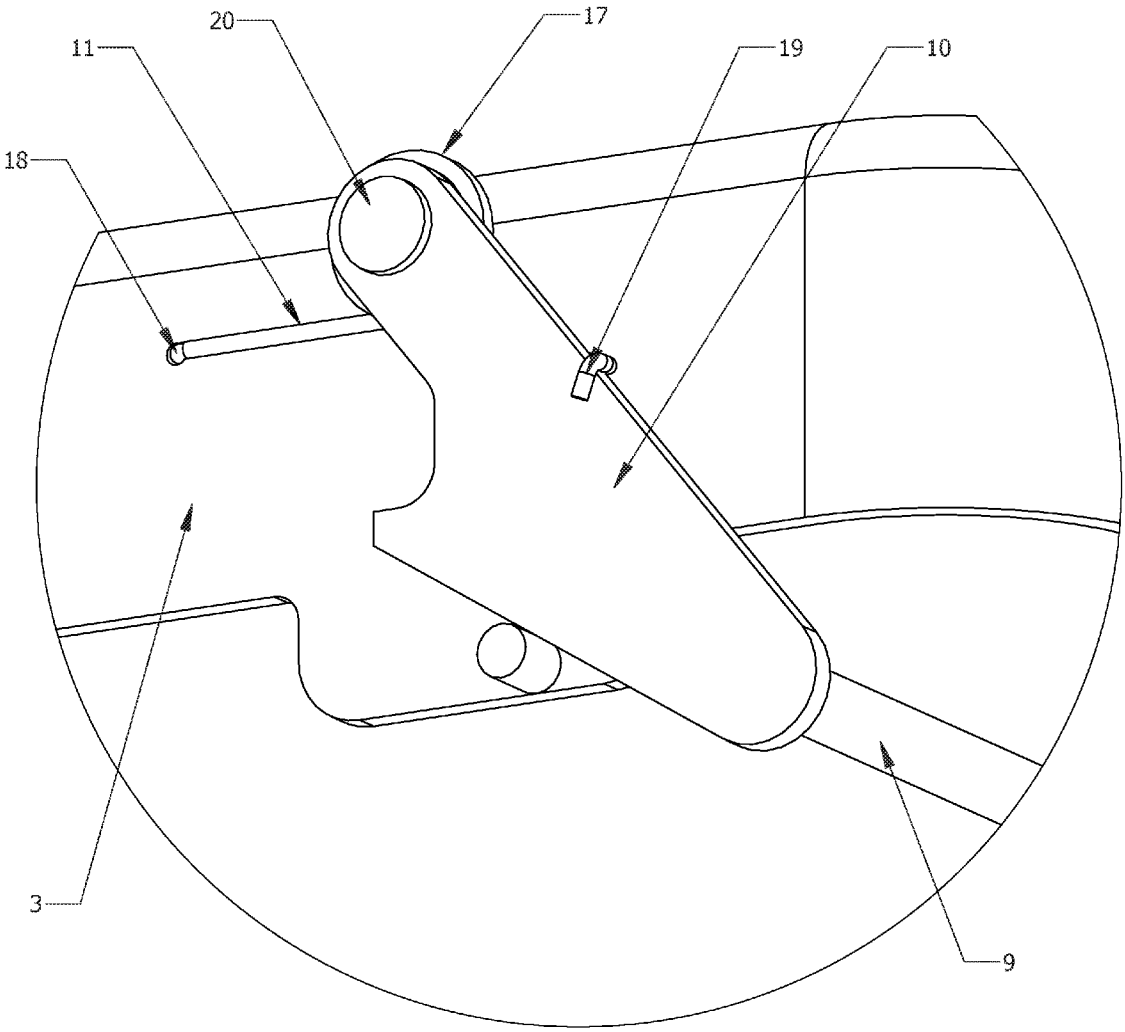
FIG. 11 shows the step and latch end.
Figure 12:
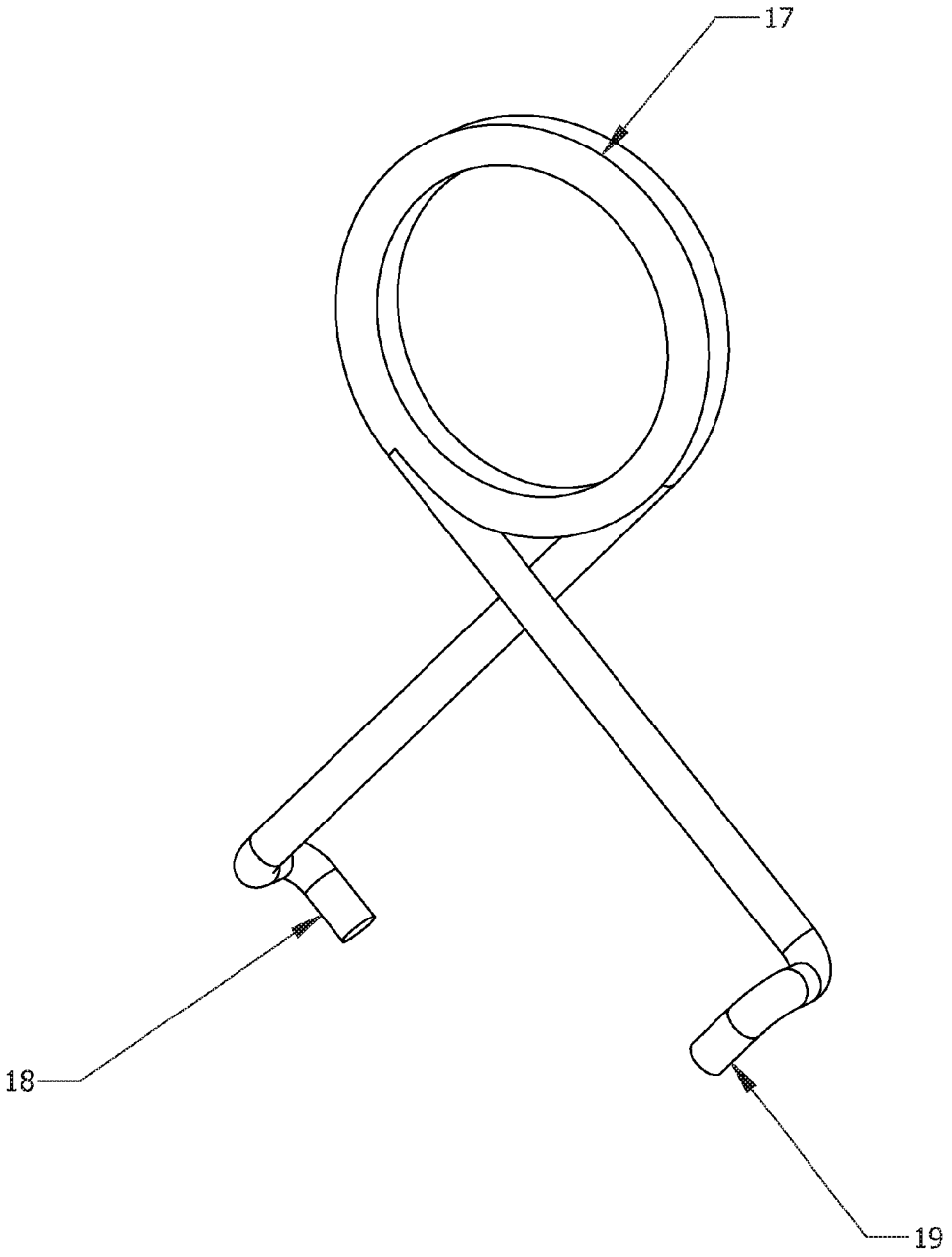
FIG. 12 shows the spring.
Figure 13:
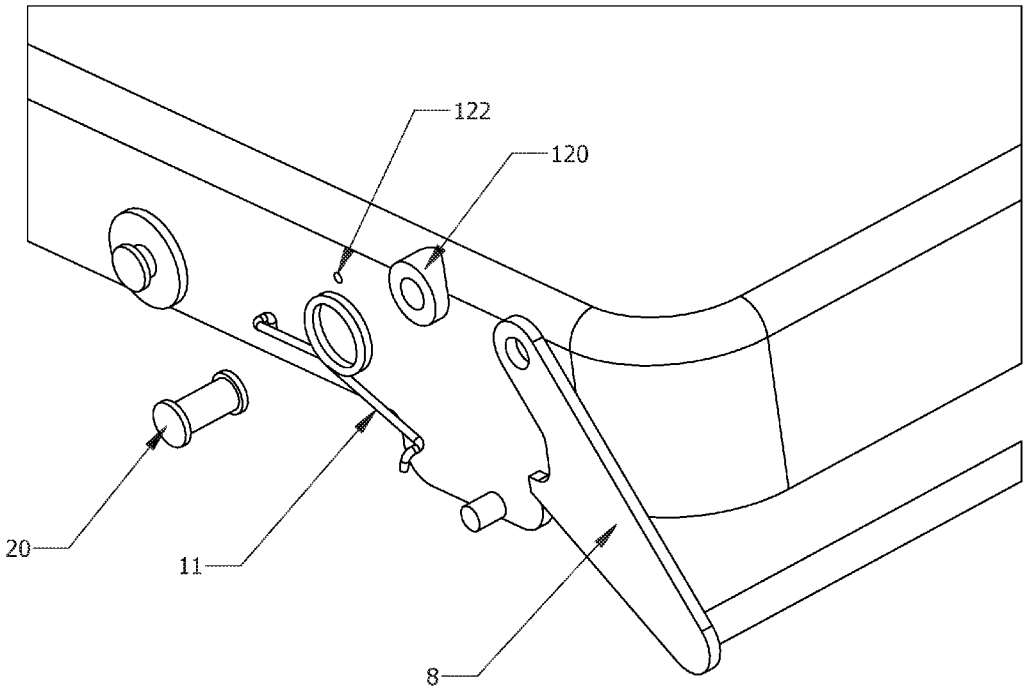
FIG. 13 shows the assembly of the latch end and step.

Additional details of the springs 11 and their mounting can be seen in FIG. 11. In this Figure the rear legs and step link are not shown. The springs 11 consists of a coiled section 17 and two ends and is similar to the torsion spring of a common clothes pin. (FIG. 12 shows the spring in its relaxed state.) The coiled section 17 is installed concentric with the latch pivot 20. The fixed end 18 is hooked into a hole 122 in the step 3 and the moving end 19 is hooked over the latch end 10. By comparing FIG. 6 and FIG. 7 it can be seen that when the latch 8 is moved toward the unlatched position, the fixed end 18 does not move but the moving end 19 moves with the latch 8 and biases the latch back toward the latched position. The latch pivot 20 is a rivet which extends through a latch end 10 and a boss 120 on the step 3 and about which the coil section 17 of the spring 11 is positioned."

Two studs 13 (seen in FIGS. 2, 3, & 5) serve to attach the step links 5 to the rear legs 2 and provide engagement points for the latch 8. In FIG. 5 the step 3 has been removed to show one stud 13 more clearly. The studs 13 do not support the step 3 in any way.

Note, FIGS. 6, 7, 8, & 9 are phantom views with components shown "wireform". These views show the right side of the stepladder but it should be understood that the stepladder and all its latch components are symmetric about the center plane.

Figure 6:
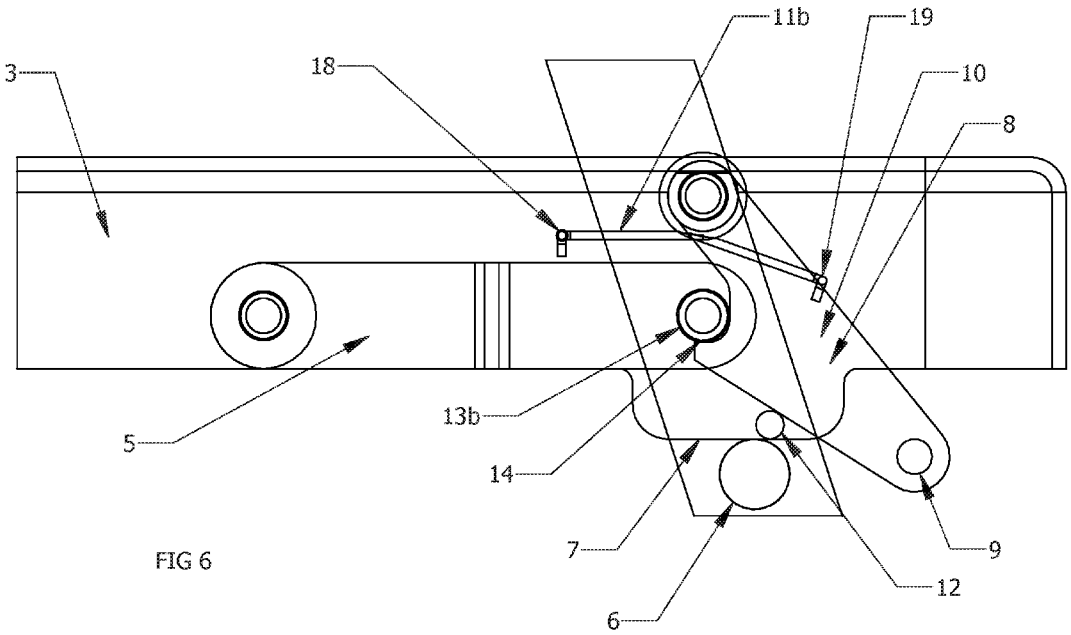
FIG. 6 is a side view of the step and latch end.
Figure 10:
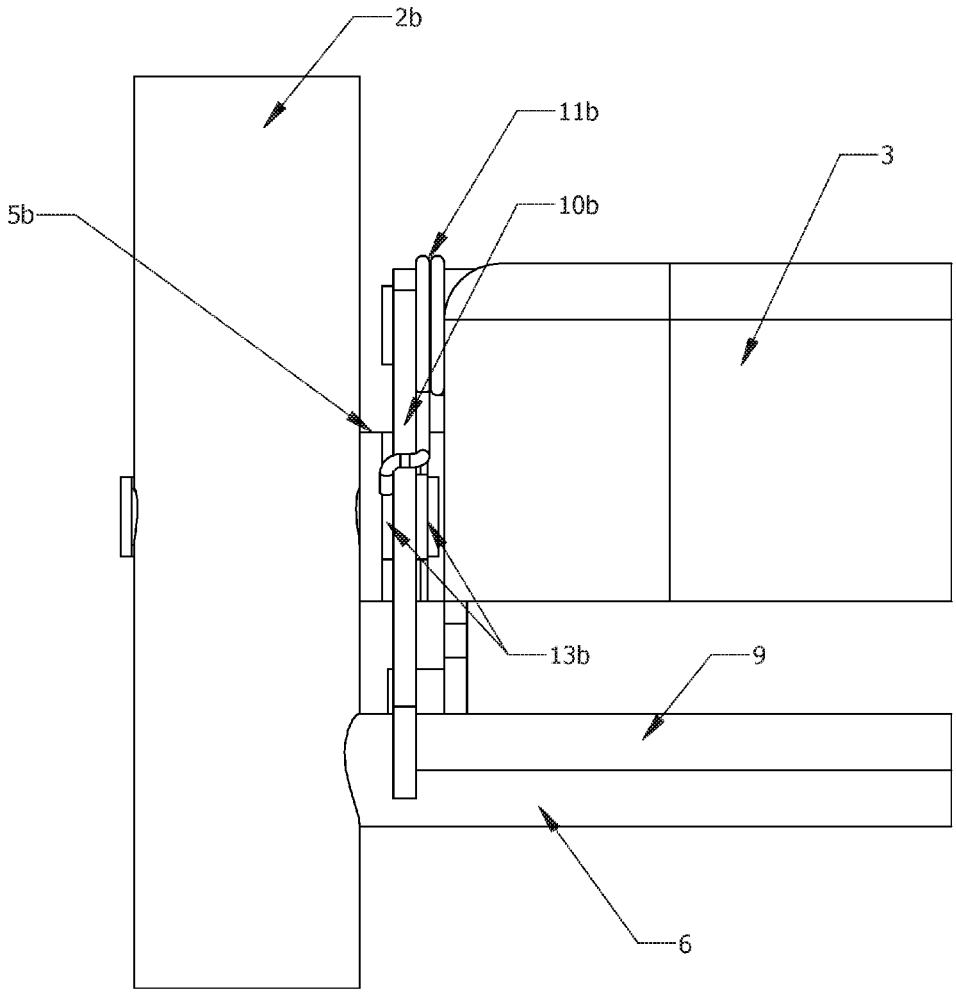
FIG. 10 shows the step and latch end.

FIG. 6 shows the stepladder when fully opened and the latch 8 in the fully engaged position. The hook 14 portion of the latch end 10 is beneath the stud 13 and held there by the torque supplied by the spring 11. In this position the latch positively prevents the stepladder from folding. FIG. 10 is a closeup of the right side latch components as seen from the rear 112 when the latch is fully engaged.

Figure 7:
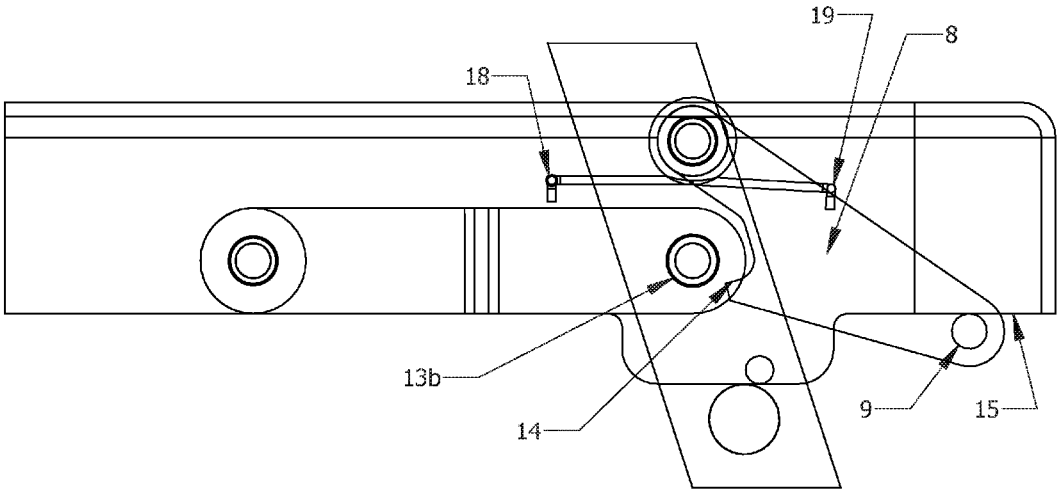
FIG. 7 is a side view of the step and latch end.

FIG. 7 shows how the latch 8 is disengaged from the stud 13 in order to fold the stepladder. The user reaches under the rear 112 of the step 3 and lifts up on the latch bar 9 of the latch 8. The latch 8 will rotate against spring 11 torque until the latch bar 9 contacts the underside 15 of the step 3. By that time the hook 14 portion of the latch end 10 has disengaged from the stud 13. The user can then lift up the rear 112 of the step 3 to fold the stepladder. Once the rear 112 of the step 3 has risen a short distance the user may allow the latch 8 to return to the position seen in FIGS. 3 & 4.

Figure 9:
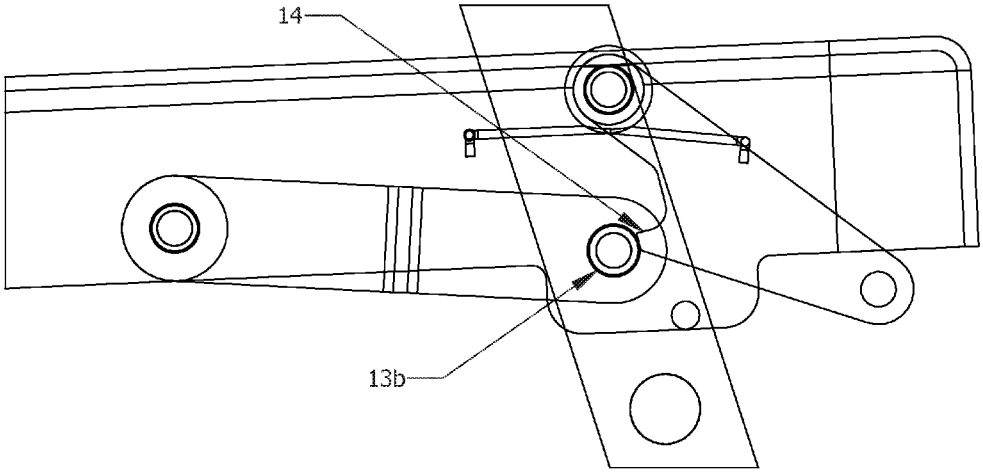
FIG. 9 is a side view of the step and latch end.

To move the stepladder to its open and latched position the user pushes the rear edge of the step 3 rearward and downward. FIG. 8 shows the cam 16 portion of the latch 8 as it contacts the stud 13. Continued downward motion of the rear edge of the step 3 causes the latch 8 to rotate CCW (as viewed) so that its hook 14 portion is able to bypass the stud 13 as seen in FIG. 9. As seen in FIG. 6, when the projections 7 on the step 3 contact the cross bar 6, the latch 8 returns under spring 11 torque to its fully engaged position. The user is assured that the latch is engaged by hearing and feeling it snap into its engaged position.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

The invention claimed is:

1. A method of positioning a stepladder, the method comprising the steps of:

providing the stepladder, the stepladder comprising:

a front section having a first front leg and a second front leg, a step configured to support a user, the step being attached to the first front leg and the second front leg, the step including a first side, a second side, a front, a rear, a first step link attached to and positioned between a first rear leg and the first side of the step, the step including a second step link attached to and positioned between a second rear leg and the second side of the step, a latch engaged with the step, a rear section having the first rear leg, the second rear leg and a cross bar directly attached to and between the rear legs, the rear section pivotably attached to the front section, the first rear leg directly connected to a first stud, the first stud extending from the first rear leg toward the second rear leg, the first stud being separate and apart and not in contact with the second rear leg and not in contact with the cross bar, the second rear leg directly connected to a second stud, the second stud extending from the second rear leg toward the first rear leg, the second stud being separate and apart and not in contact with the first rear leg and the first stud and not in contact with the cross bar, the latch configured to move between an engaged position and a disengaged position, the latch configured to be directly latched to the first stud to lock the first front leg and the first rear leg in an open position forming an inverted V shape when in the engaged position, wherein the latch prevents the front and rear sections from folding together when in the engaged position, the latch configured to be pulled up from the engaged position to the disengaged positioned to disengage the latch from the first stud to allow the front and rear sections to fold together into a closed position in which the first rear leg and the first front leg are in parallel, the latch includes a latch bar directly connected to and between a first latch end and a second latch end, the second latch end configured to engage with the second stud, the latch bar configured to cause the first and second latch ends to move in unison, the latch bar being disposed below the step when the latch is in the engaged position, the latch includes a restoring mechanism configured to bias the first and second latch ends toward the engaged position, the restoring mechanism includes a first spring which engages with the first latch end and a second spring which engages with the second latch end, the crossbar directly contacting and supporting the rear of the step when the latch is in the engaged position, each of said latch ends has a cam portion and hook portion; the latch ends configured so that as the cam portion contacts a respective stud of said first and second studs when the rear of the step is moved downward toward the open position, the cam portion moves so that the hook portion bypasses the respective stud until the hook portion clears the respective stud which causes a respective spring of said springs to bias the hook portion to engage the respective stud to place the latch into the engaged position;

pivoting the front section relative to the rear section in order to pivot the ladder into the open position;

engaging the latch to the first stud in order to position the stepladder into the engaged position;

pulling up on the latch in order to move the latch from the engaged position to the disengaged position; and folding the front and rear sections together into the closed position.

2. The method of claim 1, further comprising the steps of:

contacting the first stud with a first of said cam portions;

moving the first of said cam portions so that a first of said hook portions bypasses the first stud; and moving the first of said hook portions to engage the first stud in order to place the latch into the engaged position after the first of said hook portions clears the first stud.

* * * * *